United States Patent [19]

Takeuchi et al.

[11] 4,407,248

[45] Oct. 4, 1983

[54] ELECTRONICALLY CONTROLLED CARBURETOR

[75] Inventors: Yuzo Takeuchi, Nagoya; Toshihide Kimura, Aichi; Shigetaka Takada, Obu, all of Japan

[73] Assignee: Aisan Kogyo Kabushiki Kaisha, Obu, Japan

[21] Appl. No.: 341,087

[22] Filed: Jan. 20, 1982

[30] Foreign Application Priority Data

Jan. 26, 1981 [JP] Japan ..... 56-10495

[51] Int. Cl.[3] ..... F02B 33/00; F02M 7/00

[52] U.S. Cl. ..... 123/439; 123/438; 123/494; 261/DIG. 74; 261/44 C

[58] Field of Search ..... 123/438, 439, 494; 261/DIG. 74, 44 C, 121 B, 43 A

[56] References Cited

U.S. PATENT DOCUMENTS

| | | | |
|---|---|---|---|
| 3,900,014 | 8/1975 | Bundesen et al. | 123/439 |
| 4,083,338 | 4/1978 | Berthing et al. | 123/439 |
| 4,153,021 | 5/1979 | Hattori et al. | 123/439 |
| 4,172,436 | 10/1979 | Mennesson | 123/438 |
| 4,290,399 | 9/1981 | Takada et al. | 123/439 |
| 4,314,535 | 2/1982 | Takeuchi et al. | 123/439 |
| 4,341,190 | 7/1982 | Ishikawa et al. | 123/439 |

*Primary Examiner*—Raymond A. Nelli

*Attorney, Agent, or Firm*—Dennison, Meserole, Pollack & Scheiner

[57] ABSTRACT

An electronically controlled carburetor for an internal combustion engine for a vehicle has a variable venturi for varying the venturi cross-section and concurrently varying the amount of air metered into the venturi in response to the engine demands an air flow sensor for sensing the displacement of the variable venturi and producing related electrical signals in response to changes in air flow through the venturi, a main fuel nozzle for discharging metered fuel into the venturi, a fuel flow sensor for sensing pressure differential of fuel across a main fuel jet communicating with the main fuel nozzle and for producing related electrical signals in response to changes in fuel flow through the main fuel jet, an air bleed controlling actuator for controlling the amount of air to be bled into the main fuel nozzle, and a control circuit responsive to the output signals from the air flow sensor and the fuel flow sensor for driving the air bleed controlling actuator. With this arrangement, the amount of air bleed may be controlled so as to set the ratio of air-to-fuel at an arbitrary fixed value at all times.

3 Claims, 7 Drawing Figures

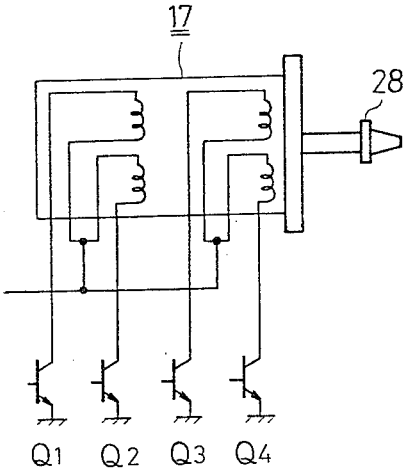
Fig 3
| STEP | Q1 | Q2 | Q3 | Q4 |
|---|---|---|---|---|
| 1 | ON | OFF | ON | OFF |
| 2 | ON | OFF | OFF | ON |
| 3 | OFF | ON | OFF | ON |
| 4 | OFF | ON | ON | OFF |
| 5 | ON | OFF | ON | ON |
CW ↓ ↑ CCW
Fig 4
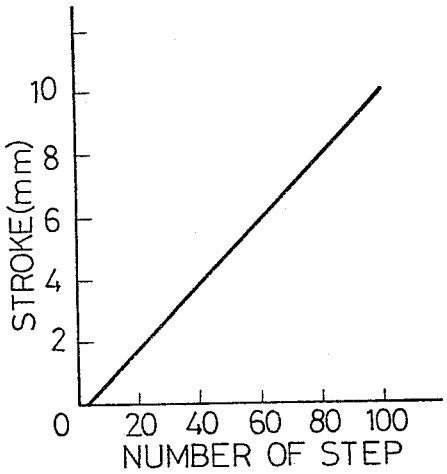
Fig 5
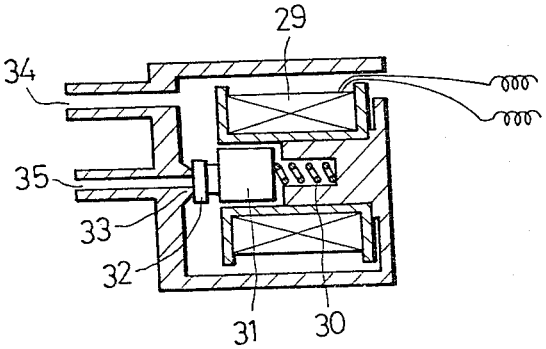
Fig 6
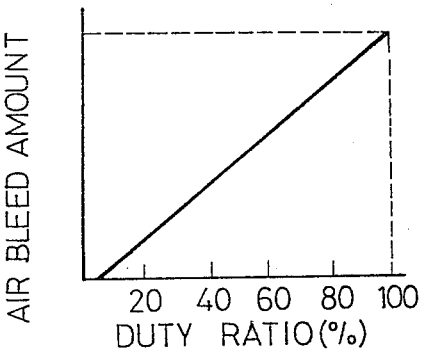
Fig 7

ELECTRONICALLY CONTROLLED CARBURETOR

BACKGROUND OF THE INVENTION

1. Field of the Invention

This invention relates to an electronically controlled carburetor for an internal combustion engine for a vehicle which is effective to electronically control the air bleed amount in response to changes in the air and fuel flows through the venturi thereof and to supply optimum air-fuel mixture to the internal combustion engine.

2. Description of the Prior Art

Heretofore there have been proposed a number of electronically controlled carburetors for the mixture of fuel and air. For example, the prior art carburetor, in trying to control the air-to-fuel ratio of the mixture, has employed the use of an oxygen ($O_2$) sensor installed in the engine exhaust pipe which is effective to open and close the fuel passage of the carburetor in response to the $O_2$-sensing signal, or to drive an air bleed controlling actuator effective to govern the rate of fuel flow. It should be noted that, in such a prior art carburetor, the mixture may be controlled at all times to a theoretical air-to-fuel ratio, because of the sensor responsive to the presence of $O_2$ in the exhaust gas. However, the mere control of mixture to such a theoretical air-to-fuel ratio has been deemed to be insufficient, because of increasing requirements for minimizing fuel consumption in view of the fuel economy of automotive engines, and also of governmentally imposed limitations on engine exhaust emissions in view of anti-pollution movement.

Furthermore, the prior art electronically controlled carburetor is disadvantageous in that the cooperative oxygen sensor fails to function, because the activating temperature of the sensor is not reached when the engine is cold, and consequently, the carburetor fails to control the air-to-fuel ratio so long as the engine is cold.

SUMMARY OF THE INVENTION

An object of the present invention is to provide a novel, electronically controlled carburetor which eleminates the disadvantages associated with the prior art.

Another object of the present invention is to provide an electronically controlled carburetor which will be able to automatically supply the automotive engine with air-fuel mixture having arbitrary ratio of air-to-fuel, will reduce fuel consumption, and will decrease exhaust emissions.

A further object of the present invention is to provide an electronically controlled carburetor which may feed richer air-fuel mixture readily and stably to the engine even when it is cold.

A still further object of the present invention is to provide an electronically controlled carburetor which will be able to maintain the rate of air through the venturi at the constant level and at high speeds, will enhance the atomization of fuel from the main fuel nozzle, and will control the ratio of air-to-fuel with high degree of accuracy.

A still further object of the present invention is to provide a carburetor which is highly responsive to engine demands, and wherein the cooperating air bleed controlling actuator may be installed independently of the carburetor, thereby permitting a compact carburetor construction.

According to the invention, an electronically controlled carburetor is provided for an internal combustion engine for a vehicle having a variable venturi for varying the venturi cross-section and concurrently varying the amount of air metered into the venturi in response to the engine operating conditions, an air flow sensor for sensing the displacement of the variable venturi and producing related electrical signals in response to changes in air flow through the venturi, a main fuel nozzle for discharging metered fuel into the venturi, a fuel flow sensor for sensing pressure differential of fuel across a main fuel jet communicating with the main fuel nozzle and for producing related electrical signals in response to changes in fuel flow through the main fuel jet, an air bleed controlling actuator for controlling the amount of air to be bled into the main fuel nozzle, and a control circuit responsive to the output signals from the air flow sensor and the fuel flow sensor for driving the air bleed controlling actuator. With this arrangement, the amount of air bleed may be controlled so as to set the ratio of air-to-fuel at an arbitrary fixed value at all times.

Various general and specific objects, advantages and aspects of the invention will become apparent when reference is made to the following detailed description considered in conjunction with the accompanying drawings.

BRIEF DESCRIPTION OF THE DRAWINGS

FIG. 3 is a schematic view of the stepping motor operated actuator according to the preferred embodiments;

FIG. 4 is an illustrative diagram showing the sequence of the actuator shown in FIG. 3;

FIG. 5 is a graph illustrating the stepping operation of the actuator shown in FIG. 3;

FIG. 6 is a schematic view of the electromagnetic valve operated actuator according to an alternate embodiment; and FIG. 7 is a graph illustrating the operation of the actuator shown in FIG. 6.

DESCRIPTION OF THE PREFERRED EMBODIMENTS

Figure 1:
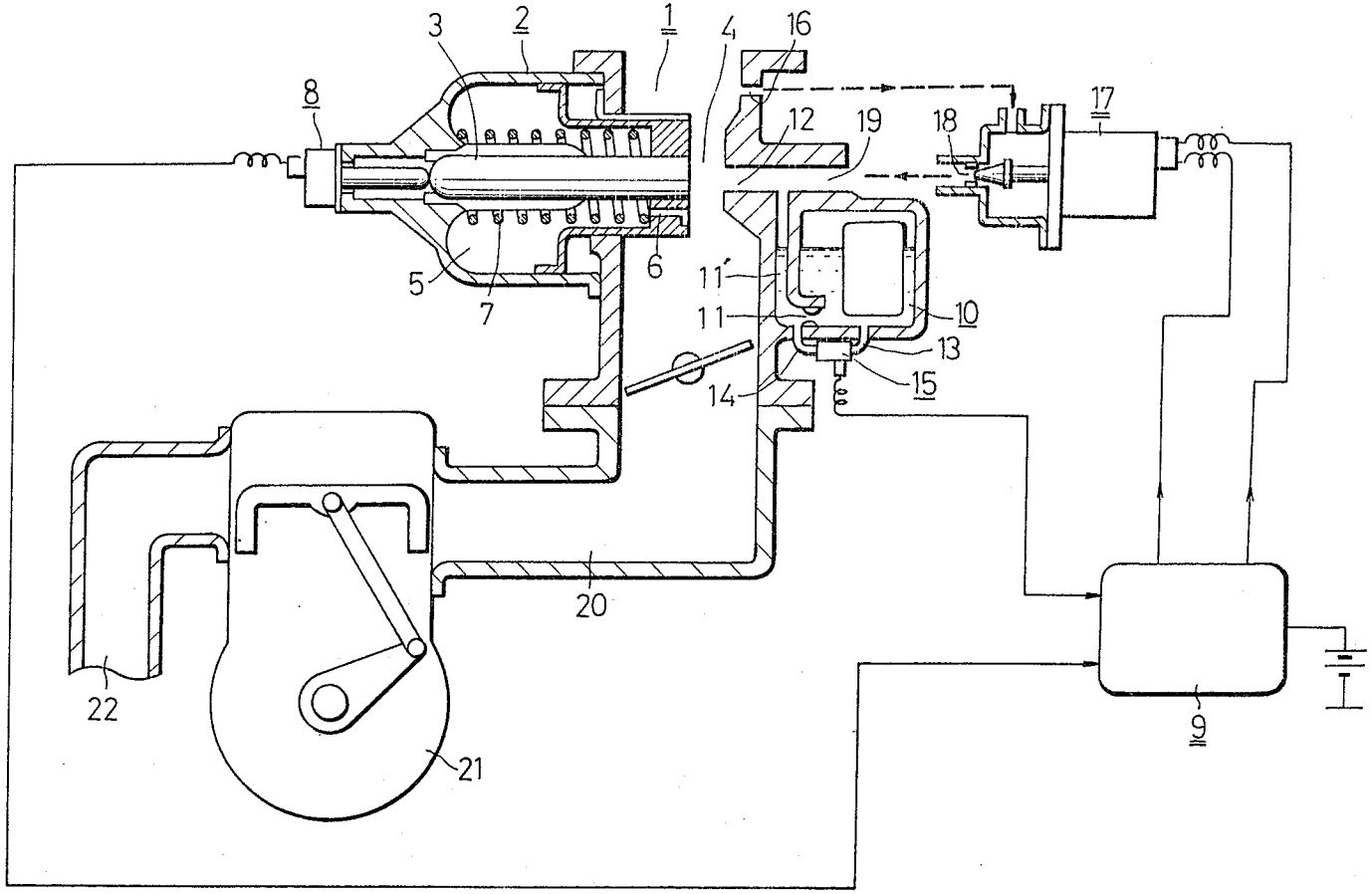
FIG. 1 is a diagramatic view of the general arrangement of a preferred embodiment according to the present invention.

Referring now in greater detail to the drawings and in particular FIG. 1 which illustrates the general arrangement of a preferred embodiment according to the present invention, there is shown a carburetor body 1 having a variable venturi 2 which in turn has a movable shaft 3 therein, its right-hand end (as viewed in FIG. 1) extending into the air passage 4 of the carburetor body 1 and serving as a venturi section. Further, a shaft chamber 5 communicates with the air passage 4 through a passage 6 and is exposed to negative pressure produced in the air passage 4, and the movable shaft 3 is always urged by a spring 7 in the rightward direction (as viewed in FIG. 1). Consequently, the movable shaft 3 remains stationary at a position where the flowing-air pressure and the biasing force of the spring 7 are balanced, that is, a position corresponding to the rate of air flow through the air passage 4. The movable shaft 3 has a stroke sensor or air flow sensor 8 attached to the left-hand end thereof which is effective to produce related electrical signals in response to both the rightward and leftward travel of the movable shaft 3 refrective of the engine operating conditions and apply input signals to a control circuit 9 electrically connected thereto.

A float chamber 10 well known in the art is provided in the carburetor body 1. Fuel in the float chamber 10 flows through a main fuel jet 11 into a passage 11' and through a main fuel nozzle 12 into the air passage 4. A pressure-differential sensor or fuel flow sensor 15 is provided across the main fuel jet 11 through passages 13 and 14. The pressure-differential sensor 15 senses changes in fuel pressure-differential across the main fuel jet 11, that is changes in rate of fuel flow in response to the engine operating conditions, and produce related electrical signals in response to the changes to apply input signals to the control circuit 9 electrically connected thereto.

Additionally, the carburetor body 1 includes an air bleed controlling actuator 17 operatively connected thereto through an air bleed inlet 16. The air bleed controlling actuator 17 has an air bleed jet 18 communicating with a passage 19 which in turn communicates with the main fuel nozzle 12, and is electrically connected to the output of the control circuit 9 so that the air bleed amount may be controlled by the signal outputted from the control circuit 9. Additionally, the carburetor body 1 is attached to the engine body 21 through the intake manifold 20, and the engine body 21 includes the exhaust manifold attached thereto.

Figure 2:
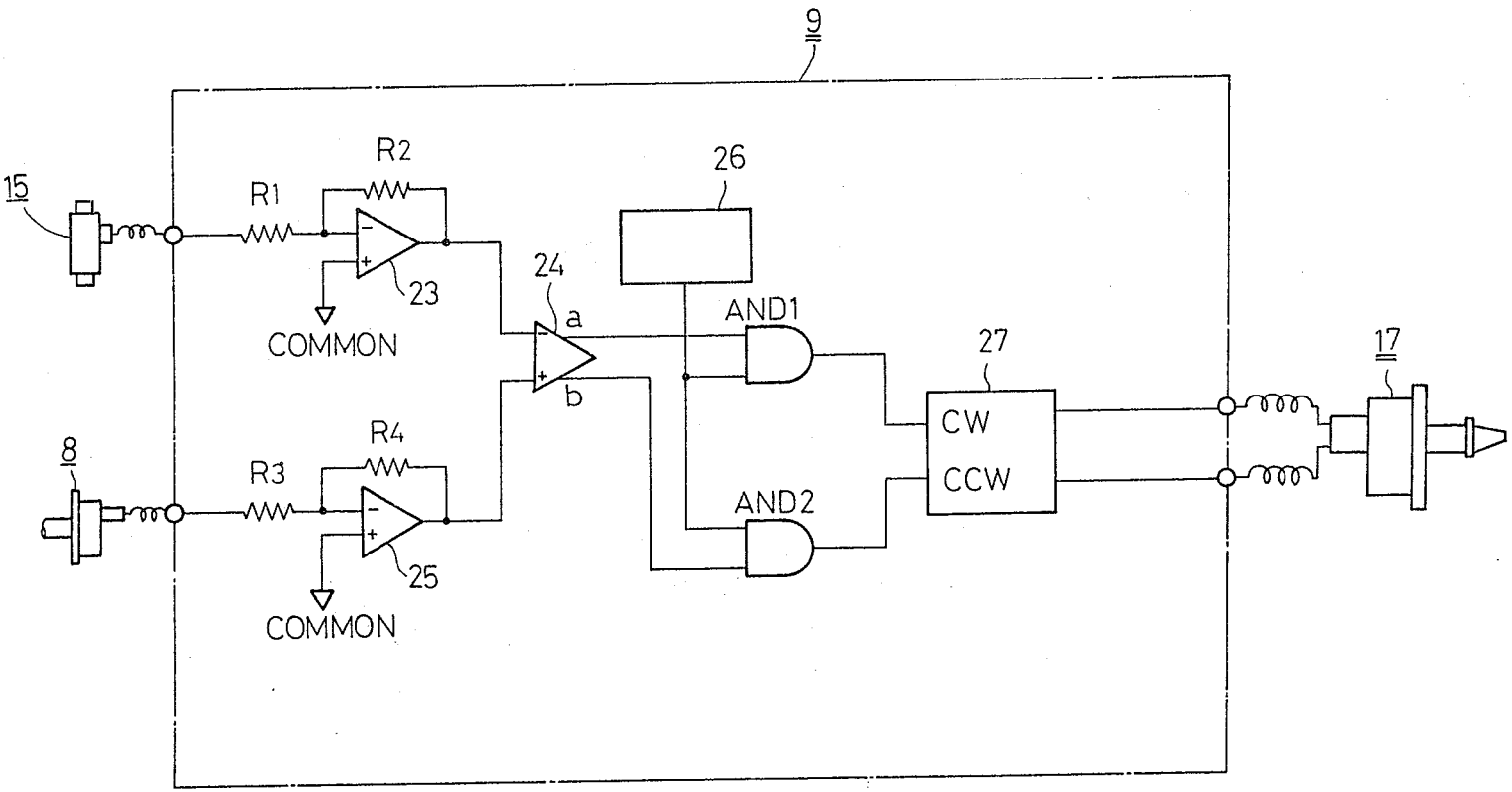
FIG. 2 is a schematic diagram of the electrical circuit used in the control circuit of the preferred embodiment shown in FIG. 1.

Attention is now directed to FIG. 2 which illustrates the electrical circuit of the control circuit 9. The output of the pressure-differential sensor 15 is electrically connected to a first operational amplifier 23 through a resistance R1. The output of the operatinal amplifier 23, being regulated and leveled by a resistance R2, is connected to one of the input terminals of a comparator 24. Moreover, the output of the stroke sensor 8 is electrically connected to a second operational amplifier 25 through a resistance R3. The output of the operational amplifier 25, being regulated and leveled by a resistance R4, is connected to the other input terminal of the comparator 24. The first output terminal a of the comparator 24 is connected to an AND circuit AND1; and the second output terminal b, to an AND circuit AND2. A pulse oscillator 26 is connected to each of the AND circuits AND1 and AND2, while each output of the AND circuits AND1 and AND2 is connected to a driving circuit 27. The output terminals of the driving circuit 27 are electrically connected to the air bleed controlling actuator 17.

Attention is now directed to FIG. 3 which illustrates a preferred embodiment wherein the air bleed controlling actuator 17 is an actuator operated by a 4-phase stepping motor. The stepping motor incorporates a permanent magnetic rotor, coils L1, L2, L3 and L4, and a mechanism for converting the rotor rotation into a linear motion, which mechanism is effective to cause a cooperating output shaft 28 to move linearly so as to determine the effective opening area of the air bleed jet 18. Furthermore, the coils L1, L2, L3 and L4 are connected to transistors Q1, Q2, Q3 and Q4 respectively of the control circuit 9. In accordance with the on-off sequence of the transistors Q1, Q2, Q3 and Q4, as shown in FIG. 4, the rotor is rotated steppingly in the clockwise direction CW or the counterclockwise direction CCW. In this embodiment, the output shaft 28 may be displaced 10 mm in 100 steps, as shown in FIG. 5.

Next, attention is directed to FIG. 6 which illustrates an alternate embodiment wherein the air bleed controlling actuator 17 is replaced by an electromagnetic valve. In this instance, the electromagnetic valve is opened and closed in response to the duty ratio of the control circuit 9 so as to adjust the air bleed amount. As generally seen, the electromagnetic valve comprises a coil connected to the control circuit 9, an armature 31 resiliently urged by a spring 30, a valve member 32 secured to the armature 31, a valve seat 33 against which the valve member 32 is seated, an inlet port 34, and an outlet port 35. Upon energization of the coil 29, the spring 30 is compressed to thereby move the valve member 32 away from the valve seat 33. Consequently, air flows from the inlet port 34 to the outlet port 35. Conversely, upon deenergization of the coil 29, the valve member 32 is returned to its original position by the repulsive force of the spring 30 so as to shut off the air flow. Thus, it is to be noted that the air bleed amount may be altered, as shown in a graph in FIG. 7, in response to the output duty ratio of the control circuit 9.

In operation, when the movable shaft 3 of the variable venturi 2 is displaced in response to the engine operating conditions, the stroke sensor 8 detects the corresponding displacement and applies output signals into the operational amplifier 23 of the control circuit 9. In response to this, the fuel flow drawn from the main fuel nozzle 12 varies to thereby alter the fuel pressure across the main fuel jet 11. The pressure-differential sensor 15 detects the corresponding pressure differential and produces related signals in response thereto to apply input signals to the operational amplifier 25 of the control circuit 9.

It should be appreciated that the stroke sensor 8 attached to the variable venturi 2 serves as a sensor for the air flow through the venturi, and also the pressure-differential sensor 15 attached to the float chamber 10 serves as a sensor for the fuel amount the main fuel nozzle 12 injects. Each signal of the sensors 8 and 15 is amplified in the respective operational amplifiers 23 and 25. The outputs of the operational amplifiers 23 and 25 are then inputted to the comparator 24, so as to be compared and outputted to the output terminal a or b. It is contemplated that if, at this time, the output terminal a is of high potential, the terminal b outputs low potential, which will be fed to the drive circuit 27 as a pulse signal from the pulse oscillator 26 through the AND circuit AND1 or AND2. The drive circuit 27 distinguishes the direction of rotation of the stepping motor, that is either clockwise or counterclockwise, so as to drive the air bleed controlling actuator 17. Thus the amount of air bleed may be controlled and concurrently, the air flow and the fuel flow controlled, the ratio of air-to-fuel being fixed and stable. As the result, the ratio of air-to-fuel of the mixture to be fed to the engine may be controlled arbitrarily and automatically to the valve preset in the control circuit 9.

The air-to-fuel ratio may be determined by changing the ratio of resistance R1 to R2 or the ratio of resistance R3 to R4 which in turn changes the gain of the operational amplifiers 23 and 25. For example, if it is desired to increase (enrich) the air-to-fuel ratio when the engine is cold, the cooling water temperature is sensed and consequently the ratio of resistance R1 to R2 is merely changed so as to provide a richer air-fuel mixture automatically.

While the invention has been particularly shown and described with reference to preferred embodiments thereof, it will be understood by those skilled in the art that the foregoing and other changes in form and details can be made without departing from the spirit and scope of the invention.

What is claimed is:

1. An electronically controlled carburetor for an internal combustion engine for a vehicle comprising a variable venturi for varying the venturi cross-section and concurrently varying the amount of air metered into said venturi in response to the engine operating conditions, an air flow sensor for sensing the displacement of said variable venturi and producing related electrical signals in response to changes in air flow through said venturi, a main fuel nozzle for discharging metered fuel into said venturi, a fuel flow sensor for sensing pressure differential of fuel across a main fuel jet communicating with said main fuel nozzle, said fuel flow sensor producing related electrical signals in response to changes in fuel flow through said main fuel jet, an air bleed controlling actuator for controlling the amount of air to be bled into said main fuel nozzle, and a control circuit responsive to the output signals from said air flow sensor and said fuel flow sensor for driving said air bleed controlling actuator, whereby the amount of air bleed may be controlled so as to set the ratio of air-to-fuel at an arbitrary fixed value at all times.

2. The invention as defined in claim 1 wherein said air bleed controlling actuator is actuated by a stepping motor.

3. The invention as defined in claim 1 wherein said air bleed controlling actuator is an electromagnetic valve adapted to be opened and closed in response to the duty ratio of said control circuit so as to adjust the air bleed amount.

* * * * *